United States Patent [19]

Niikura

[11] Patent Number: 4,820,176

[45] Date of Patent: Apr. 11, 1989

[54] ELECTRIC POWER SUPPLY CONNECTOR

[75] Inventor: Isamu Niikura, Hiratsuka, Japan

[73] Assignee: Shiraishi Electric Corporation, Tokyo, Japan

[21] Appl. No.: 129,778

[22] Filed: Dec. 7, 1987

[30] Foreign Application Priority Data

| | | | |
|---|---|---|---|
| Sep. 7, 1987 | [JP] | Japan | 62-136697[U] |
| Sep. 7, 1987 | [JP] | Japan | 62-136698[U] |
| Oct. 14, 1987 | [JP] | Japan | 62-157374[U] |

[51] Int. Cl.[4] ..... H01R 13/635

[52] U.S. Cl. ..... 439/152; 439/159; 439/160

[58] Field of Search ..... 439/152, 159, 160; 200/51.09

[56] References Cited

U.S. PATENT DOCUMENTS

| | | | |
|---|---|---|---|
| 1,900,782 | 3/1933 | Way | 439/160 |
| 2,161,353 | 6/1939 | Hummel | 439/160 |
| 4,042,292 | 8/1977 | Chensky | 439/160 |
| 4,645,282 | 2/1987 | Frear | 439/160 |
| 4,750,890 | 6/1988 | Dube et al. | 439/152 |

*Primary Examiner*—William L. Sikes
*Assistant Examiner*—Frank González
*Attorney, Agent, or Firm*—Holman & Stern

[57] ABSTRACT

An electric power supply connector such as a plug or a plug adapter for supplying a power source voltage to an electrical appliance. The connector has conductive connecting legs of a metallic material having high electrical conductivity and formed to be projected from or recessed into the surface of a main part of the connector. An actuating member is resiliently urged to extend from the inside to the outside of the connector so as to be able to project from a surface of the main part of the connector. The connector also includes a locking mechanism including a locking groove formed in a wall of the actuating means and a portion of an interlocking member which is movable in the direction perpendicular to the actuating member and urged by a spring, the portion of the interlocking member being engageable with the locking groove by the force of the spring then the, the locking means being adapted to lock, through the engagement between the portion of the interlocking member and the locking groove, the actuating member in a retracted state where the end of the actuating member is held near the surface of the main body of the connector. The connector further has an unlocking mechanism for unlocking the actuating member from the retracted state by urging the interlocking member against the force of the spring, by a manual force or by an electromagnetic force.

18 Claims, 13 Drawing Sheets

ELECTRIC POWER SUPPLY CONNECTOR

BACKGROUND OF THE INVENTION AND PRIOR ART STATEMENT

The present invention relates to an electric power supply connector such as a power supply plug for connecting an electrical appliance to a power supply receptacle or a power supply plug adapter which is connected between a power supply plug and a power supply receptacle. More particularly, the invention is concerned with an improved electric power supply connector which can easily be disengaged from a power supply receptacle by a simple action.

Electric power supply connectors such as power supply plugs are used widely. For disconnecting a power supply from a power supply source, the user pinches the plug by his fingers and then pulls the plug off the receptacle. When the receptacle is an unfixed one connected to a fixed power source through an extension code, the user is obliged to use two hands: one for fixing the receptacle and the other for pulling the plug.

This disconnecting operation essentially requires that the power supply plug is pulled in a predetermined direction, as well as a certain level of force and skill. In addition, both hands are inconveniently occupied when the power supply receptacle is of the type provided on an extension code.

SUMMARY OF THE INVENTION

Accordingly, an object of the present invention is to provide an electric power supply connector such as a power supply plug or a power supply plug adapter which can easily be disconnected electrically and mechanically from a power supply receptacle by a simple operation.

To this end, according to the present invention, there is provided an electric power supply connector for supplying a power source voltage to an electrical appliance, the connector having the following features:

connecting means made of a metallic material having high electrical conductivity and formed to be projected from or recessed into the surface of a main part of the connector;

actuating means resiliently urged to project from the inside to the outside of the connector so as to be able to project from a surface of the main part of the connector;

locking means including a locking groove formed in a wall of the actuating means and a portion of an interlocking member which is movable in the direction perpendicular to the actuating member and urged by a spring, the portion of the interlocking member being engageable with the locking groove by the force of the spring when the, the locking means being adapted to lock, through the engagement between the portion of the interlocking member and the locking groove, the actuating member in a retracted state where the end of the actuating member is held near the surface of the main body of the connector; and unlocking means for unlocking the actuating member from the retracted state by urging the interlocking member against the force of the spring.

In one form of the present invention, the unlocking means includes a push button provided on one end of the interlocking member and projected laterally from a side of the connector so as to be manually pressed against the force of the spring thereby unlocking the actuating member from the retracted state.

In another form of the invention, the unlocking means includes an expandable and contractable bellow receiving an end of a power supply cord, a spring disposed in the bellows and adapted for contracting the bellows, a string having one end retained at a position near the hole receiving the power supply cord and the other end connected to the interlocking member, whereby, as the power supply cord is pulled, the bellows is expanded to pull the string thereby causing the interlocking member to move against the force of the spring.

In still another form of the invention, the unlocking means includes a solenoid with a coil wound thereon, the solenoid being adapted to produce, when the coil is energized, a force which acts against the force of the spring.

The above and other objects, features and advantages of the present invention will become clear from the following description of the preferred embodiments when the same is read in conjunction with the accompanying drawings.

DESCRIPTION OF THE PREFERRED EMBODIMENTS

Figure 2:
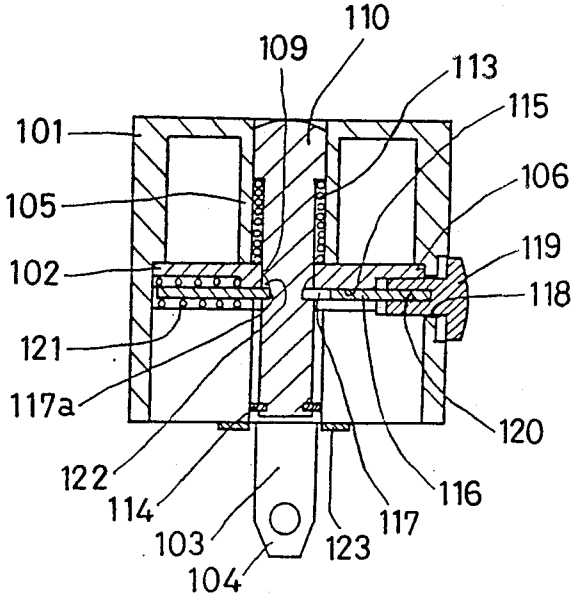
FIG. 2 is a sectional view taken along the line I–I′ of FIG. 1, with an actuating member of the connector moved in a retracted position.
Figure 1:
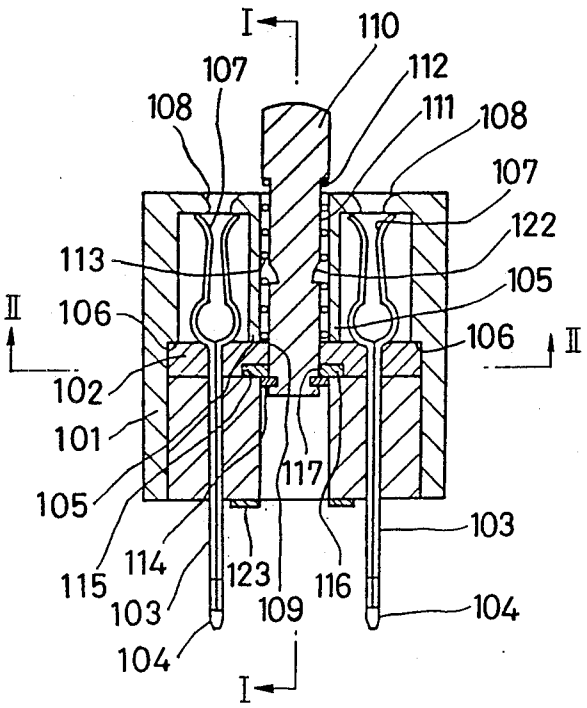
FIG. 1 is a sectional view of an electric power supply plug adapter as an embodiment of an electric power supply connector in accordance with the present invention.
Figure 4:
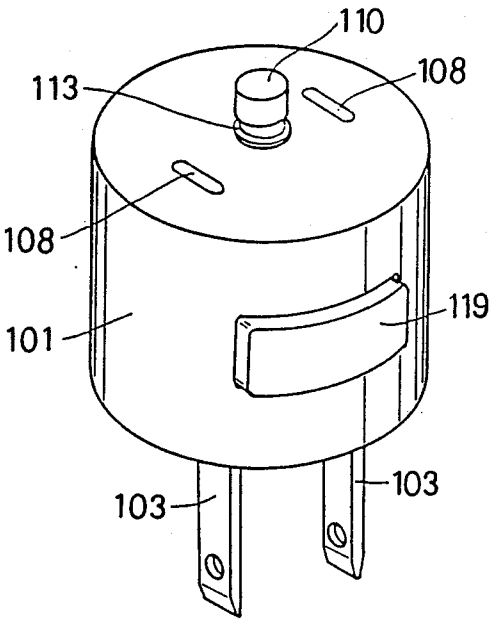
FIG. 4 is a perspective view of the embodiment shown in FIG. 1.

Preferred embodiments of the present invention will be described hereinunder with reference to the accompanying drawings.

FIGS. 1 to 4 show an electric power supply plug adapter. The electric power supply plug adapter (referred to simply as "plug connector", hereinafter) has a hollow cylindrical main part 101 and a disk-shaped insulator 102 placed therein. The plug adapter further has a pair of electrode legs 104 constituting electrodes 103 and having high electrical conductivity. The electrode legs 104 are fixed within the adapter main part 101 in contact with a cylindrical upright wall 105 and a groove 106 formed in the adapter main part 101, in such a manner that the legs 104 project from the adapter main part 101. The electrode legs 104 are provided on their ends opposite to the projected ends with concaved connecting portions 107 which are adapted to receive connecting legs (not shown) of a power supply cap (not shown) which are inserted through corresponding holes 108, 108 formed in the top wall of the adapter 101.

A cylindrical actuating member 110 is received in a cylindrical bore which is defined by the cylindrical wall 105 and the central bore 9 formed in the insulator 102. The actuating member 110 is provided in the outer peripheral surface thereof with a groove 111 which is recessed from the level of the outer peripheral surface of the end portion of the actuating member 110. An operation spring 113 is disposed to surround the recessed groove 111 so as to act between the insulator 102 and the shoulder portion of the actuating member 110 defining the upper end of the above-mentioned groove 111. The spring 113 acts on the actuating member 110 so as to urge the latter upward thereby causing the upper end of the actuating member 101 to project upward from the top surface of the actuator main part 101. The actuating member 110 is provided with a stopper 114 fixed to a lower portion thereof. The stopper 114 prevents the actuating member 110 from upwardly coming off the adapter main part 110 by the force of the spring 113.

The main part of the insulator 102 is provided in the underside thereof with an elongated groove 115 which extends in the direction substantially perpendicular to a line which interconnects the pair of electrode legs 103. An interlocking member 116 is received in this groove 115. The interlocking member 116 is provided with a central bore 117 as in the case of the insulator 102 so as to be penetrated by the actuating member 110. The adapter main part 101 is provided in one side thereof with a hole 118 which receives a push button 119 provided with a head of a diameter greater than the diameter of the hole 118. The portion of the push button 119 received in the main part 110 is provided with a groove 120 which fittingly receives the aforementioned interlocking member 116. The interlocking member 116 is movable perpendicularly to the actuating member 110 and constitutes an unlocking means for unlocking the actuating member 116.

Figure 3:
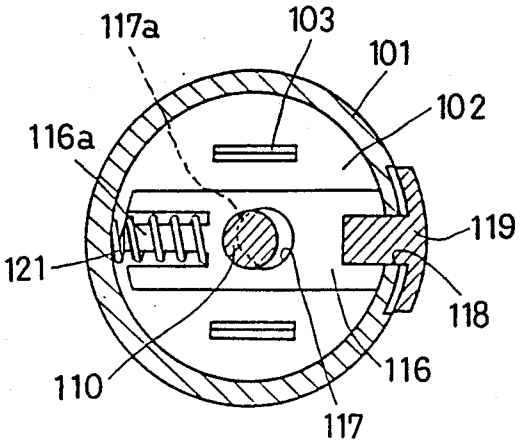
FIG. 3 is a sectional view taken along the line II–II′ of FIG. 1, with an actuating member of the connector moved in a retracted position.

As will be seen from FIG. 3, the interlocking member 116 is provided on one end thereof with three projections the central one **116*a* of which carries a coiled spring 121 one end of which abuts the inner surface of the adapter main part 101 so as to urge the interlocking member 110 towards the push button 119. The actuating member 110 is provided substantially at the center thereof with a lock groove 122 which fittingly receives a part of the interlocking member 116. Thus, a lock mechanism for locking the actuating member 110 at a retracted position is constituted by a lock groove 122 formed in the peripheral wall of the actuating member 110, the interlocking member 116 and the coiled spring 121**.

A sheet 123 of a flexible material such as a rubber or vinyl is adhered to the underside of the insulator 102, so as to improve the closeness of the contact between the power supply receptacle and the adapter, while absorbing any shock which is generated when the actuating member 110 is projected.

In use, the legs 104 of the electrodes 103 are inserted into a power supply receptacle provided on a wall or on the end of an extension cord. Then, connecting legs (not shown) of the power supply plug are inserted into the concaved connecting portions 107 through the openings 108 formed in the top wall of the adapter main part 101. In consequence, the actuating member 110 is pressed downward by the lower surface of the power supply plug with the operation spring 121 compressed between the insulator 102 and the wall surface 112 of the groove 111 formed in the actuating member 110. In consequence, a portion **117*a* on the left side of the hole 117 formed in the interlocking member 116, which is normal biased by the coiled spring 121 to the right as viewed in FIG. 2, is made to mate with the locking groove 122 in the actuating member 110, thereby to maintain the actuating member 110** in the retracted and locked position with one end of the actuating member 116 held in the vicinity of the concaved connecting portion 107. In this state, the interconnecting member 116 has been displaced to the right from the normal position by an amount which corresponds to the amount or length received by the locking groove 122, while the push button 119 is held such that its head slightly projects from the side surface of the adapter.

When the push button 119 is pushed while the actuating member 110 is in the retracted position, the interlocking member 116 is moved to the left as viewed in FIG. 2 overcoming the force of the coiled spring 121, whereby the interconnecting member 116 is relieved from the locking groove 122 in the actuating member 110. In consequence, the actuating member 110 is springed back upward as viewed in FIGS. 1 and 2 by the resetting force of the operation spring 113. This causes the top end of the actuating member 110 to project above the surface of the adapter 101 so as to urge the bottom surface of the electric power supply plug (not shown), whereby the connecting legs of the plug are disengaged from the concaved connecting portions 107 in the plug adapter. It will be understood that, though the stopper 114 is urged upward by the force of the spring 113, the actuating member 110 is prevented from coming off by virtue of the stopper 114 on the lower end of the actuating member 110.

If the connecting legs of the plug have not been fully inserted, the actuating member 110 cannot be locked so that the plug naturally comes off when the manual force exerted thereon is removed. This ensures that the plug is securely held in electrical connection with the plug adapter.

Figure 5:
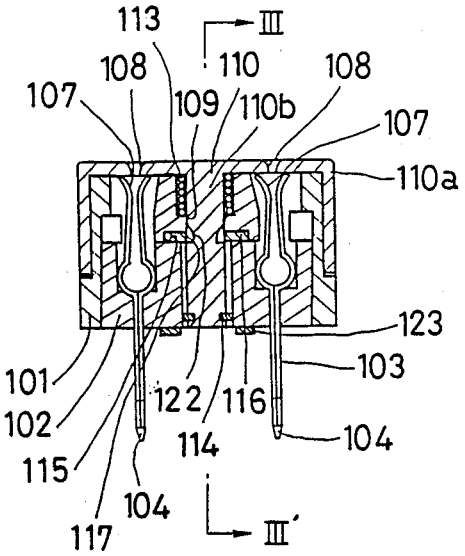
FIG. 5 is a sectional view of an electric power supply plug adapter as another embodiment of the electric power supply connector of the present invention.
Figure 6:
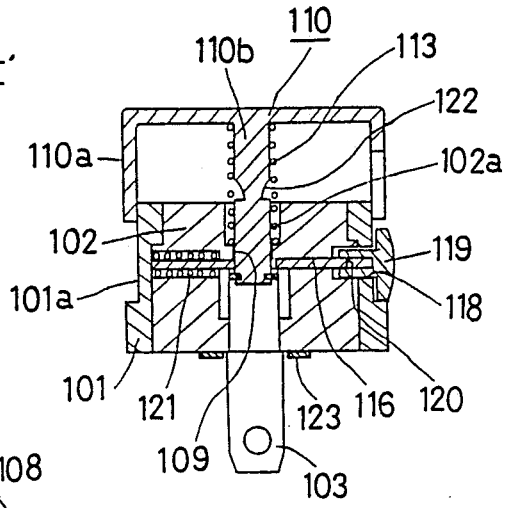
FIG. 6 is a sectional view taken along the line III–III′ of FIG. 5, with an actuating member set in a projected position.
Figure 7:
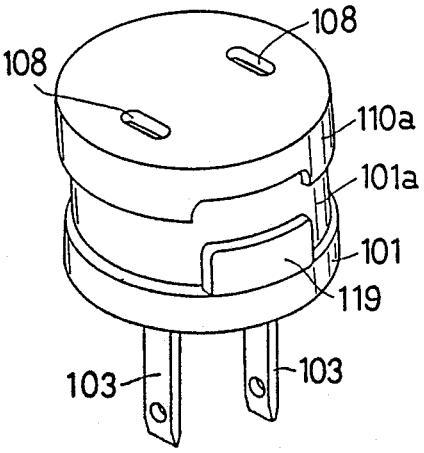
FIG. 7 is a perspective view of the embodiment shown in FIG. 5.

FIGS. 5, 6 and 7 in combination show another embodiment of the present invention. In these Figures, the same reference numerals are used to denote the same parts or members as those used in the first embodiment described hereinabove, and detailed description is omitted in regard to such parts or members.

This embodiment has an adapter main part 101 and an insulator 102 mounted in the main part 101. A pair of electrodes 103 are fixed to the insulator 102. The insulator 102 is provided with a central through bore 109 which receives an actuating member 110. The actuating member has a cover 110 opened at its one end, and a cylindrical columnar portion 110*b* which is formed to project beyond the end of the cover 1 from the center thereof. The column 110*b* is so shaped and sized as to be received in the aforementioned hole 109. The cover 110 of the actuating member 110 has an outside diameter equal to that of the adapter main part 101. The outer peripheral surface of the adapter main part 101 is partially recessed to provide a groove 101*a* which is slidably engaged by the inner peripheral surface of the cover 110*a* of the actuating member 110. Thus, the cover 110*a* slidably fit on the outer surface of the adapter main part 101. Holes 108 for receiving connecting legs of a power supply plug (not shown) are formed in portions of the cover 101*a* of the actuating member 110 corresponding to the concaved connecting portions 107 of the adapter. An operation spring 113 is wound on the column 110*b* of the actuating member 110 so as to act between the cover 110*a* and the groove 102*a* formed in the insulator 102.

The groove 101*a* in the adapter main part 101 and the sliding surface of the cover 110*a* are provided with projection and recess (not shown) which are adapted to mate with each other so as to act as guide means for allowing the actuating member 110 to move only axially relative to the main part 101, whereby the holes 108 are always held in alignment with the concaved connecting portions 107.

In use, when the connecting legs of a plug (not shown) are inserted into the holes 108 formed in the actuating member 110, the bottom of the plug presses the cover 110*a* downward so that the actuator member 101 is moved such that the cover 110*a* surrounds the adapter main part 101. In this state, the operation spring 113 is compressed and housed in the groove 102*a* in the insulator 102, and the interlocking member 116 is caused to engage with a locking groove 122 as in the case of the first embodiment. As a result, the actuating member 110 is held in the retracted position where one end of the actuating member 110 is positioned in the vicinity of the concaved connecting portions 107.

In order to unlock the actuating member 110, the push button 119 is pushed so that the interconnecting member 116 is moved against the force of the coiled spring 121 as in the case of the first embodiment, so as to be relieved from the locking groove 122. In consequence, the actuating member 110 is urged upward by the resetting force of the spring 113 so that the top surface of the actuating member 110 abuts the bottom surface of the actuating member 110 so as to lift the actuating member 110, whereby the connecting legs of the plug are separated from the concaved connecting portions 107 of the plug adapter.

Figure 8:
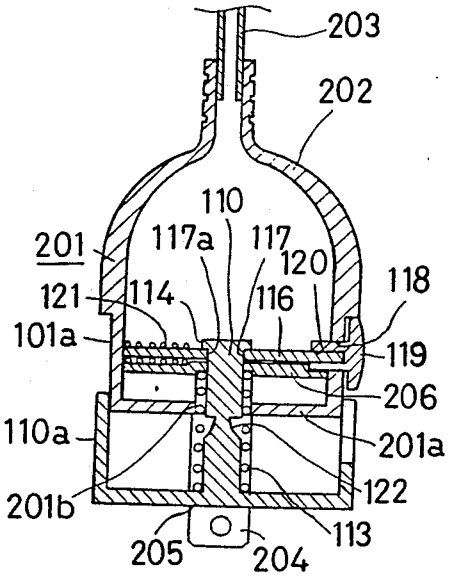
FIG. 8 is a sectional view of an electric power supply plug as still another embodiment of the present invention.

FIG. 8 shows an electric power supply plug (referred to as "plug" hereinunder) as still another embodiment of the present invention. In this Figure, the same reference numerals are used to denote the same parts or members as those appearing in FIGS. 5 to 7, and detailed description is omitted in regard to such parts or members.

The plug has a main part 201 which is made of an insulating material, and is integrally provided at its one end with a cord connecting portion 202 made of a flexible soft material such as a rubber or vinyl. A power supply cord 203, which is connected to a suitable electrical appliance A such as a vacuum cleaner, polisher or the like, is inserted into the cord connecting portion 202. The conductors of the power supply cord 3 are connected to one ends of the corresponding connecting legs 204 made of a highly conductive material. The connecting legs 204 are fixed in the main part 201 of the plug and are extended through holes 201*b* formed in the bottom surface 201*a* and through guide holes 205 formed in the cover 110 so as to project externally.

A fixing member 206 is disposed in the main part 201 of the plug and is extended between opposing walls of the main part 201 at a position above the bottom wall 201*a*. An operation spring 113 is disposed such as to act between the fixing member 206 and the cover 110*a*, in such a manner that the actuating member 110 is urged to project outward from the main part 201.

An interlocking member 116 is disposed on the upper surface of the fixing member 206 so as to orthogonally cross the actuating member 110. The actuating member 110 is extended through a central opening 117 formed in the interlocking member 116.

Figure 9:
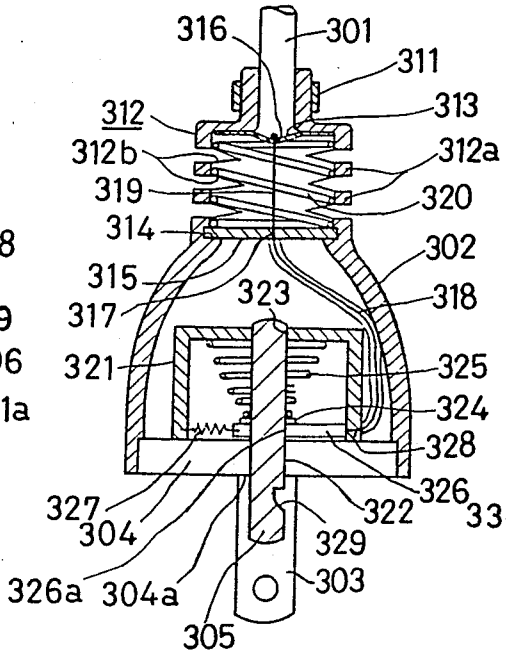
FIG. 9 is a sectional view of an electric power supply plug as a further embodiment of the present invention.
Figure 12:
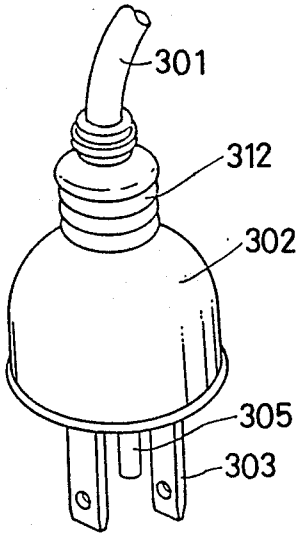
FIG. 12 is a perspective view of the embodiment shown in FIG. 9.
Figure 11:
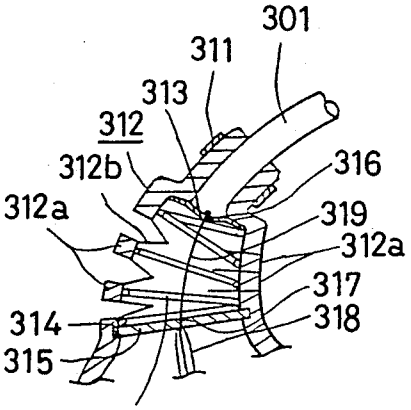
FIG. 11 is an illustration of operation of a bellows portion in the ninth embodiment of the present invention.

FIGS. 9 to 12 in combination show a power supply plug as a further embodiment of the electric power supply connector in accordance with the present invention. This plug has an appearance as shown in FIG. 12 which is a perspective view. Referring to FIG. 9, the plug has a main part 302 which is made of a soft flexible material such as a rubber, vinyl or the like. A power supply cord 301, leading to an electrical appliance such as a vacuum cleaner, iron or the like, is inserted into the main part 302 of the plug and is fixed in the latter by a clamper 311.

The cord-receiving side 310 of the plug main part 302 has an expandable and contractable bellows 12. The bellows 312 has a spiral hard bone 312*a* and a flexible diaphragm portion 312*b* appearing between each adjacent tuns of the bore 312*a*. A disk-shaped supporting plate 313 is fixed in the bellows 312 at the end of the latter adjacent to the hole for receiving the power supply cord 301. The other end of the bellow 312, i.e., the end adjacent to the plug main part 302, has a groove 314 which fixedly receives a fixing plate 315. The supporting plate 313 and the fixing plate 315 are provided with central holes 316 and 317 which receive an internal wire 319 of a string 318 which is connected to a later-mentioned locking mechanism. One end of the internal wire 319 projects above the supporting plate 313 and a suitable stopper is attached to this end of the internal wire 319 so as to prevent the wire 319 from being pulled into the space under the supporting plate 313. A spiral spring 320 is disposed in the space between the supporting plate 313 and the fixing plate 314 such as to conform with the spiral bone of the bellows 312.

An insulator 304 is fitted in one end of the plug main part 302. A pair of connecting legs 303 made from a highly conductive material, have one ends which are positioned above the insulator 304 as viewed in FIG. 14 and connected to the respective conductors of the power supply cord 301 explained before. The other ends of the connecting legs are extended through holes 304*a* formed in the insulator 304 to the exterior of the plug main part 302. A supporting wall 321 which defines a space therein is provided on the side of the insulator 304 facing the interior of the plug main part 302. The insulator 304 and the supporting wall 321 are provided with central coaxial holes 322 and 323 which receives an actuating member 305 which projects to the outside of the plug main part 302. An operation spring 325 is loaded between a spring seat 324 fixed to a substantially mid portion of the actuating member 305 and the supporting wall 321. The operation spring 325 normally urges the actuating member 305 so as to cause the latter to project outward from the plug main part 302.

The spring seat 324, which is pressed by one end of the operation spring 325, also serves to prevent the actuating member 305 from coming off the plug main part 302 in the downward direction. The length of the portion of the actuating member 305 projectable to the outside of the plug main part 302 is determined by the position at which the spring seat 324 is fixed to the actuating member 305. The operation spring 325 is a coiled spring the diameter of which varies along the axis such that the diameter is the smallest at the end contacting the spring seat 324, that is, the diameter is progressively decreased towards the end through which the connecting legs 303 project. Therefore, when the operation spring 325 has been fully compressed, the operation spring 325 has a planar form in a plane between the supporting wall 321 and the spring retainer 324.

An interconnecting member 326 having a hole 326*a* penetrated by the actuating member 305 is disposed on the upper side of the insulator 304 within the space defined by the supporting wall 321, in such a manner as to extend in the direction perpendicular to the actuating member 305. A tension coiled spring 327 has one end fixed to one end of the interlocking member 326 and the other end connected to the inner surface of the supporting wall 321, thus urging the interlocking member 326 to the left as viewed in FIG. 9. The internal wire 319 of the aforementioned string 318 is extended through a hole 328 formed in the supporting wall 321 so as to be connected to the other end of the interlocking member 326.

A locking groove 329 is formed in a portion of the outer peripheral surface of the actuating member 305 below the spring seat 324. The portion of the interlocking member 326 on the right side of the hole 326*a* is adapted to selectively engage with the locking groove 329. Thus, the locking groove 329 formed in the actuating member 305, the interlocking member 326 and the coiled spring 327 in cooperation constitute a locking mechanism which holds the actuating member 305 in the retracted position.

Figure 10:
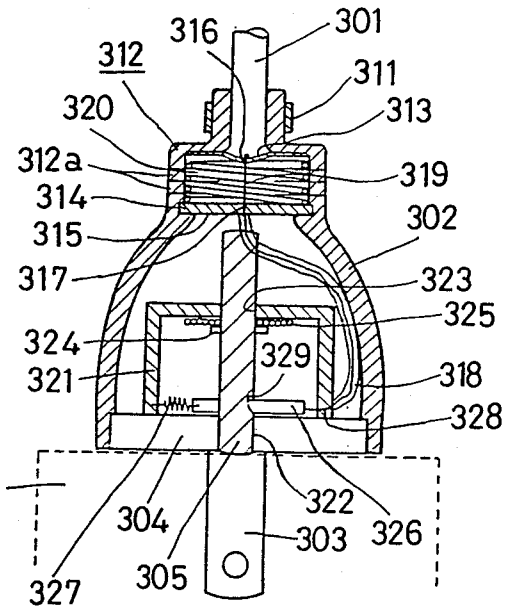
FIG. 10 is a sectional view of the embodiment shown in FIG. 9 with an actuating member held in a retracted position.

In use, the user pinches the plug main part 302 and pushes the same so as to bring the connecting legs 303 into the corresponding holes in a power supply receptacle (not shown). As a result, the actuating member 305 is pushed upward by the top surface of the receptacle so that the spring seat 24 also is moved upward correspondingly so as to compress the operation spring 325. When the actuating member 305 has been raised to a position where the locking groove 329 formed therein is aligned with the interlocking member 326, the portion of the interlocking member 326 on the right side of the hole 326*a* is brought into engagement with the locking groove 329 by the tension of the spring 327, thereby locking the actuating member 305 in the retracted position. In this state, the string 318 has been pulled by the interlocking member 326 to the left as viewed in FIG. 9 so that the end of the string 318 on the supporting plate 313 is pulled downward thereby compressing the spring 320 so as to cause the bellows 312 to be compacted with the adjacent turns of the bones 312*a* thereof held in contact with each other, as shown in FIG. 10.

When the user wishes to disconnect the plug from the receptacle, he simply pulls the power supply cord 301. Since the plug main part 302 is held on the power supply receptacle, the pulling force exerted on the power supply cord 301 causes the bellows 321 to expand, with the result that the internal wire 319 of the string 318 is pulled because the distance between the supporting plate 313 and the fixing plate 315 is increased. In consequence, the interlocking member 326 is moved to the right as viewed in the drawings overcoming the force of the coiled spring 327, thereby disengaging the interlocking member 326 from the locking groove 329.

Since the end of the plug main part 302 receiving the power supply cord 301 has a bellows type construction 312, it is possible to generate a tension in the internal wire 319 regardless of the direction in which the power supply cord 301 is pulled. For instance, assuming that the power supply cord is pulled to the right as viewed in FIG. 11, the bellows 312 is expanded at its left portion while the right portion thereof is compressed to cause the adjacent turns of the bones contact each other. It will be seen that a tension is produced also in this state so that the user can easily disconnect the power supply plug from the power supply receptacle simply by pulling the power supply cord 301 from the position where the electrical appliance is placed, regardless of the direction of the appliance with respect to the receptacle.

The term "string" is used here to generally include various members which are flexible and capable of transmitting tension, e.g., a sheathed wire.

In this embodiment, the operation spring 325 is a spiral spring the diameter of which progressively decreases towards the end from which the connecting legs 330 project. With this arrangement, a good feeling of insertion is obtained when the connecting legs of the plug are inserted into the power supply receptacle 30 because in the beginning period of compression the large diameter portion of the spiral spring having smaller resetting force is deformed. The extraction of the connecting legs from the receptacle 30 requires a large force particularly in the beginning period of extraction. The described embodiment is convenient in that, in the beginning period of extraction, the small diameter portion of the spiral spring, which produces a greater resetting force, expands first to provide a large force in the initial period of the extraction.

The actuating member 305 cannot be locked unless the connecting legs 303 of the power supply plug are fully inserted into the power supply receptacle. If the manual force pressing the plug is relieved before the actuating member 305 is locked, the plug naturally springs out by the force of the operation spring, whereby inferior contact between the plug and the connector is avoided.

In the embodiments described hereinbefore, the connecting legs 104 are formed integrally with the concaved connecting portions 107. This, however, is only illustrative and the described embodiments can be constructed as a table tap in which extension cords are connected to the concaved connecting portions 107 and a plug which is to be inserted into a fixed power supply receptacle is connected to the other ends of the extension cords.

FIGS. 13 to 18 shows a power supply plug as a still further embodiment of the present invention. This embodiment has means for electrically unlocking the actuating member from the retracted state.

Figure 13:
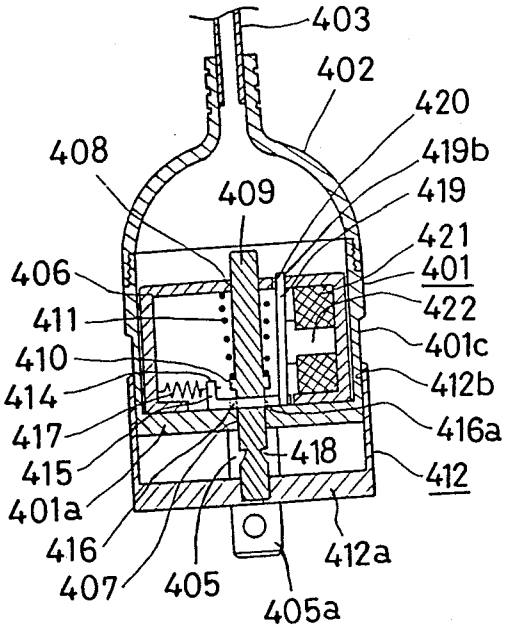
FIG. 13 is a sectional view of an electric power supply plug as still further embodiment of the present invention.
Figure 15:
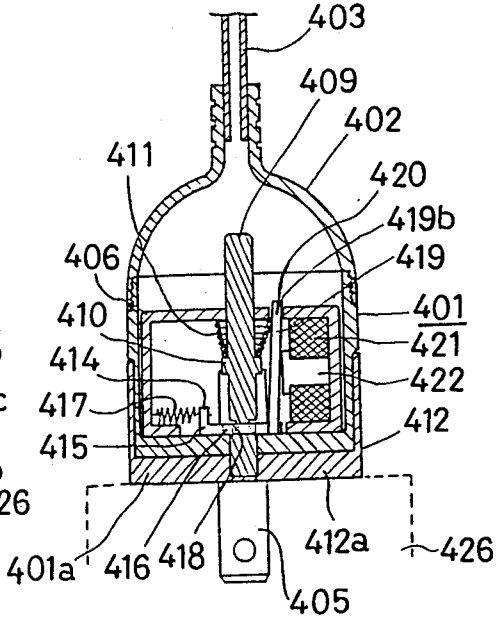
FIG. 15 is a sectional view of the embodiment shown in FIG. 13 with the actuating member held in the retracted position.
Figure 14:
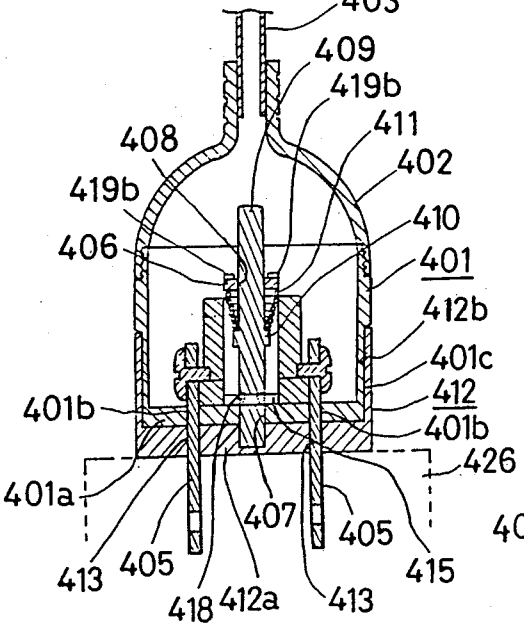
FIG. 14 is a sectional view of the embodiment shown in FIG. 13 with a actuating member held in a retracted position.

FIG. 13 is a schematic sectional view of the power supply plug of this embodiment in the state before the insertion into the power supply receptacle. FIGS. 14 and 15 are sectional views of the plug after insertion into a power supply receptacle.

The plug has a cylindrical plug main part 401 made of an insulating material and is provided on one end thereof with a cord connecting portion 402 made of a soft flexible material such as a rubber or vinyl. The cord connecting portion 402 receives a power supply cord 403 which is connected to an electrical appliance such as a vacuum cleaner or a polisher. The plug also has a pair of connecting legs 405, 405 made of a highly conductive material and connected at their one ends to corresponding conductors of the power supply cord 403. The connecting legs 405, 405 are fixed at their one ends by screws while their other ends project to the outside of the plug main part 401 through holes **401*b* which are formed in the bottom wall 401*a* of the plug main part 401**.

A supporting wall 406 is fixed in the plug main part 401. The supporting wall 406 defines a space therein. Holes 407 and 408 are formed in the centers of the bottom wall **401*a* of the plug main part 401 and the supporting wall 406 so as to receive an actuating member 940 which projects from the interior to the exterior of the plug main part 401. A spring seat 410 is formed on a substantially mid portion of the actuating member 9, and an operation spring 411 is set so as to act between the spring seat 410 and the supporting wall 406. The operation spring 411 urges the actuating member 409 so as to cause the latter to project outward from the plug main part 401**.

The spring seat 410 which retains one end of the operation spring 411 also serves as a stopper which prevents the actuating member 409 from coming off the plug main part 401. The length over which the actuating member 409 is projectable beyond the lower end of the plug main part 401 is determined by the position of the spring seat 410 on the actuating member 409. The operation spring 411 is a spiral spring the diameter of which progressively increases towards the end adjacent to the supporting wall 406, i.e., progressively decreases towards the end from which the connecting legs 405 project.

A cylindrical cover 412 having a bottom wall **412*a* is connected to the end of the actuating member 9 in such a manner that the open end of the cover 412 faces the plug main body 401. Guide holes 413, 413 penetrated by the connecting legs 405, 405 are formed in the bottom wall 412*a* of the cover 412. The cover 412 has an outside diameter which is substantially the same as that of the plug main part 401. The outer peripheral surface of the plug main part 401 around the connecting legs 405 is recessed to form a groove 401*c* with which the inner peripheral surface 12*b* of the cover 412 slidably contacts, whereby the cover 412 slidably fits on the plug main part 401, while allowing the connecting legs 405 to be move relatively to the cover 412 through the guide holes 413**.

In the normal state of operation, the cover 412 is urged downward by the operation spring 411 so that most part of the connecting legs 405 is hidden behind the cover 412, but end extremities **405*a* of the connecting legs 405 are exposed so as to facilitate the location of the plug with respect to the receptacle such that the connecting legs 405** are aligned with the insertion holes formed in the receptacle.

A substantially L-shaped interlocking member 415 having a projection 14 formed on one end thereof is placed on the bottom surface **401*a* of the plug main part 401. The interlocking member 415 is provided with a central hole 416 which is penetrated by the actuating member 409. A coiled spring 417 is stretched between the projection 414 and a portion of the supporting wall 406 so as to urge the interlocking member 415 to the left as viewed in the drawings thereby to keep the wall portion 416*a* of a hole 416 in the interlocking member 415 in contact with the corresponding side wall of the actuating member 409. The hole 416 is formed to extend in the direction parallel to the axis of the spring 417 and has a length which is slightly greater than the diameter of the actuating member 409. The actuating member 409 is provided with a locking groove 418 formed in the outer peripheral surface thereof below the spring seat 410 so as to be engaged by the abovementioned wall portion 416*a* of the hole 416 formed in the interlocking member 415. Namely, the locking groove 418 formed in the actuating member 409, the hole 416 formed in the interlocking member 415 and the coiled spring 417 in cooperation constitute a locking mechanism for locking the actuating member 409** at a retracted position.

Figure 16:
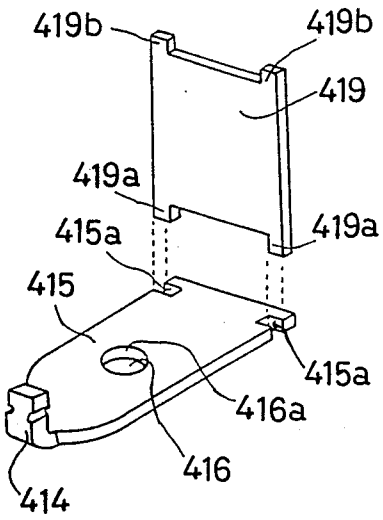
FIG. 16 is a perspective view illustrating a state of engagement between an interlocking member and a movable iron member in the embodiment shown in FIG. 13.

As will be seen from FIG. 16, the end of the interlocking member 415 opposite to the projection 414 is provided with a pair of notches **415*a*. These notches 415*a* are adapted to fittingly receive tabs 419*a* formed on both sides of a movable iron member 419 and having a width equal to the depth of the notches. The movable iron member 419 also is provided on both sides of top end thereof with tabs 419***b*, 419*b* which are received in corresponding rectangular holes 20, 20 formed in upper portions of the supporting wall 406, whereby the movable iron member 419 is held upright within the supporting wall 406. The rectangular holes 420, 420 loosely receiving the movable iron member 419 are sized to have a length slightly greater than the thickness of the movable iron member 419 in the longitudinal direction of the interlocking member 415, so that the interlocking member 415 engaging with the movable iron member 419 is slightly movable in the longitudinal direction thereof.

A solenoid 422 with a coil 421 wound thereon is placed on the outer side of the movable iron member 419 within the space defined by the supporting wall 406. When the coil 421 is energized, the solenoid 422 produces an electromagnetic attracting force which imparts a force to the interlocking member in the direction for unlocking the actuating member 409 from the retracted state.

Figure 18:
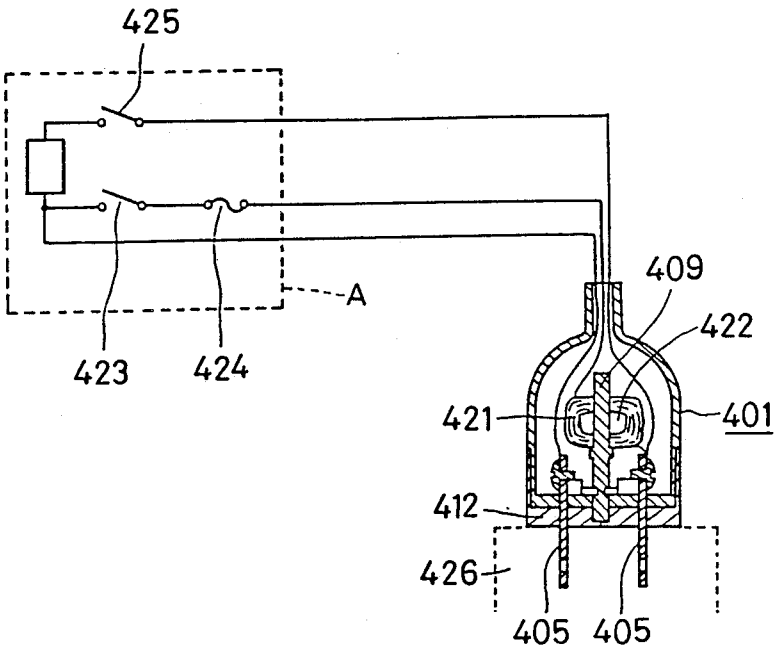
FIG. 18 is an illustration of electric wiring in the embodiment shown in FIG. 13.
Figure 17:
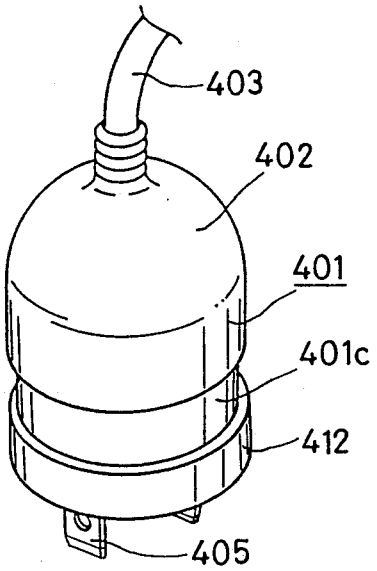
FIG. 17 is a perspective view of the embodiment shown in FIG. 13.

FIG. 18 shows the electric wiring laid in this embodiment. A switch 423 for selectively energizing the coil 421 is provided in the vicinity of an electrical appliance A. The switch 23 is connected at its one side to one of the connecting legs 405 through the coil 421 of the solenoid 422 and at its other side to the other connecting leg 405. Since the coil 21 is adapted to be supplied with rated electric current for a short time, a fuse 424 or a resistor or another suitable safety circuit is provided between the switch 423 and the coil 421. A reference numeral 425 denotes a switch for loading the electrical appliance A.

The operation of this embodiment is as follows.

For the purpose of connecting the plug to a receptacle 426, the user pinches the plug main part 401 and presses the same onto the receptacle with the connecting legs 405 received in the insertion holes in the receptacle. In consequence, the surface of the cover 412 is pressed upward by the top surface of the receptacle 426 so that the actuating member 409 and, hence, the spring seat 410 are moved upward while compressing the operation spring 411. When the actuating member 409 has been raised to a position where the locking groove 418 formed therein is aligned with the interlocking member 415, the portion 416*a* on the hole 416 of the interlocking member 415 is brought into engagement with the locking groove 418, thereby locking the actuating member 415 in the retracted state.

Since most portion of the connecting legs 405 is hidden behind the cover 412, only a small risk exists for the user to be electrically shocked by any exposed conductive part of the plug, until the connection is completed.

For disconnecting the plug from the receptacle 426, the user simply closes the switch 423 provided in the vicinity of the electrical appliance A, so that A.C. current is supplied to the coil 421 of the solenoid 422 from the power supply. In consequence, the movable iron member 419 is attracted to move to the right as viewed in FIG. 15 so as to displace the interlocking member 415 in the same direction, thereby allowing the wall portion 416*a* of the hole 416 to be disengaged from the locking groove 418. As a result, the actuating member 409 and the cover 412 are moved downward by the force of the operation spring 411 to project downward from the plug main part 401 so as to press the surface of the receptacle 426, whereby the connecting legs 405 are withdrawn from the receptacle 426 by the reactional force. The electric power supplied to the coil 421 is preferably as current which changes its level cyclically and repetitionally, e.g., an A.C. current, a pulsating current, a pulse train or train of rectangular waves, so as to vibrate the movable iron member 419 thereby effectively unlocking the actuating member. The vibration of the movable iron member also cause the supporting wall 406 to vibrate, which in turn assists the operation spring 11 in withdrawing the connecting legs 405 from the receptacle 426, thus promoting the disconnecting operation.

In the described embodiment, the actuating member 409 can be unlocked by supplying electric current to the coil 421. It is therefore possible to remotely disconnect the plug from the receptacle by closing push button switch which is provided in the vicinity of the electrical appliance A.

Although in the described embodiment the coil 421 and the solenoid 422 are disposed at one side of the actuating member 409, this is only illustrative and the coil 421 and the solenoid 422 can be placed at any suitable position within the main part of the plug provided that they can effectively displace the interlocking member.

Figure 19:
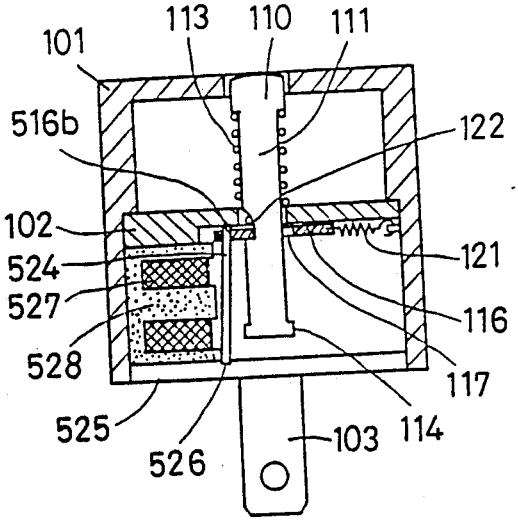
FIG. 19 is a sectional view of an electric power supply connector as a still further embodiment of the invention.
Figure 20:
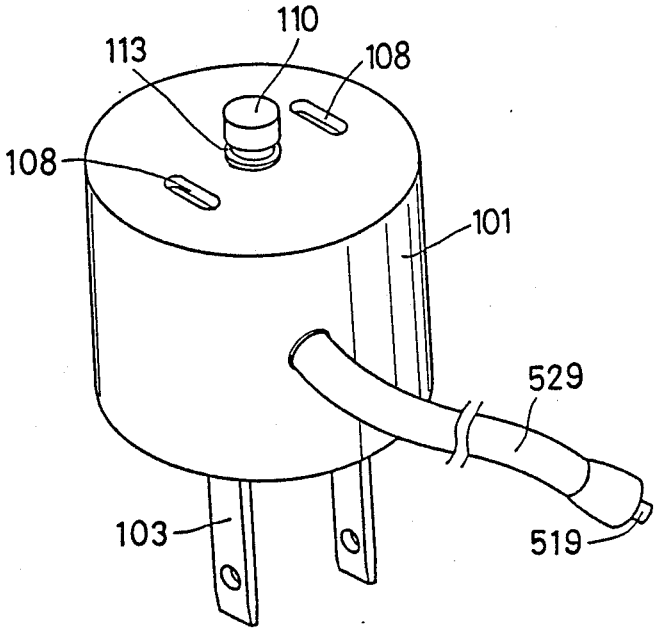
FIG. 20 is a perspective view of the embodiment shown in FIG. 19.

FIGS. 19 and 20 show an electric power supply plug adapter as a still further embodiment of the present invention. This plug adapter is basically the same as that of the embodiment explained before in connection with FIGS. 1 to 4, except that an electric unlocking means is adopted for unlocking the actuating member from the retracted state. In FIGS. 19 and 20, therefore, the same reference numeral are used to denote the same parts or members as those used in FIG. 1.

Referring to FIG. 19, a coiled spring 121 is retained by one end of an interlocking member 116 so as to urge the latter to the right as viewed in the figure. A movable iron piece 524 is fixed in a hole 516*b* formed in the other end of the interlocking member 116. The movable iron member 524 is received in a hole 526 formed inside the bottom wall 525 of the adapter main body 101 so as to protrude upright. The hole 526 which receives the movable iron member 524 has a size which is slightly greater than the size of the lower end of the movable iron member 524 so that the movable iron member is pivotable through a small angle about the lower end thereof.

A solenoid 528 having a coil 527 wound thereon is disposed below the insulator 102 in the vicinity of and at the outer side of the movable iron member 524.

The push button 59 is constructed as a switch which allows the coil 527 to be energized. One end of the switch is connected to one end of the coil 527 while the other end is connected to the other end of the coil 527 through a power supply.

When the push button switch 519 is closed to supply the electric power to the coil 527 of the solenoid 528 while the actuating member 110 is in the retracted state as shown in FIG. 19, the movable iron member 524 is attracted by the solenoid 528 to the left as viewed in the drawings, so that the interlocking member 116 is moved out of engagement with the locking groove 122, whereby the actuating member 110 is unlocked so as to be moved upward by the resetting force of the operation spring 113.

The wiring for supplying electric power to the coil 527 is omitted from FIG. 19. In this embodiment, the push button switch 519 for controlling the supply of electric power to the coil 527 is connected to the plug adapter through an extension cord 529, so that the plug connected to the plug adapter of this embodiment can be disconnected from the plug adapter by a remote control.

FIGS. 21 through 26 show different embodiments in which the actuating member in the retracted state is unlocked by electric means.

The mechanical construction of these embodiments are substantially the same as that of the embodiment shown in FIG. 13 so that detailed description thereof is omitted, with the same numerals used for denoting the same parts or members.

Figures 21, 22:
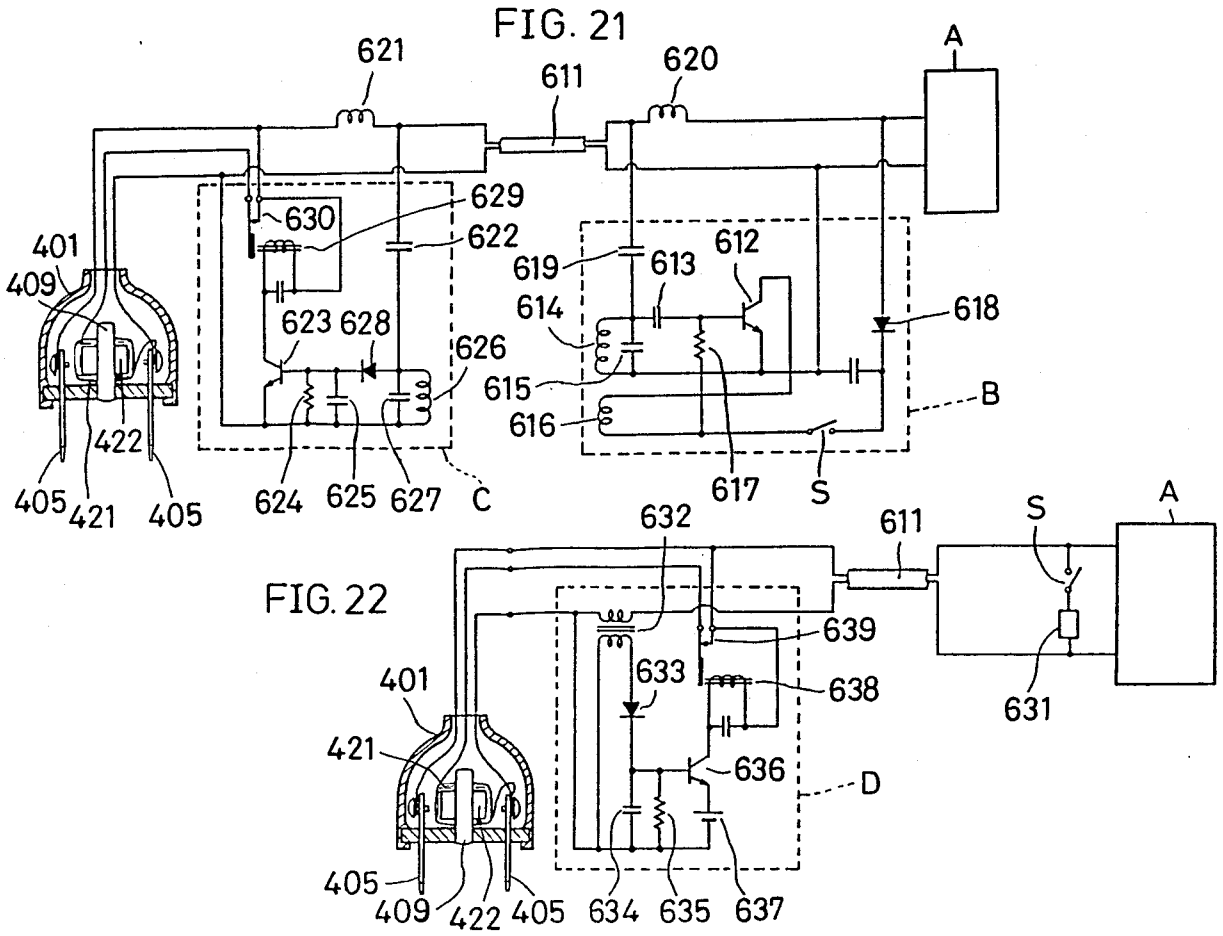
FIG. 21 is an electric wiring diagram in a still further embodiment of the present invention.
FIG. 22 is an illustration of electric wiring in a still further embodiment of the present invention.

Referring to FIG. 21, a power supply plug 401 and the electrical appliance A are connected to each other through a power supply cord 611. A high-frequency transmitter B is provided on the electrical appliance A, while the power supply plug 401 is provided with a high-frequency receiver C.

The high-frequency transmitter B has a transistor 612 the base of which is connected to the capacitor 613. A parallel connection of a coil 614 and a capacitor 615 is connected between the emitter of the transistor 612 and the capacitor 613, thus forming a resonance circuit.

The collector of the transistor 612 is connected to a coil 616 for a positive feedback and further to the base of the transistor 612 through a resistor 617. The coil 616 is connected at its one end to a switch S which in turn is connected through a diode 618 to the power supply cord 611.

The capacitor 619 is adapted for interrupting the commercial power, while the coil 620 is intended for preventing the high-frequency wave from the high-frequency transmitter B from being supplied to the electrical appliance A. A coil 621 for interrupting high-frequency wave is provided also in the portion of the power supply cord 611 adjacent to the plug 401. The high-frequency receiver C is connected to the end of the coil 621 adjacent to the electrical appliance A. A capacitor 622 is used for interrupting the commercial power.

A parallel circuit of a resistor 624 and a capacitor 625 are connected between the base and the emitter of a transistor 623 in the high-frequency receiver C. A resonance circuit constituted by a parallel connection of a coil 626 and a capacitor 627 is connected to the capacitor 622. One end of the capacitor 622 is connected to the base of the transistor 623 through the diode 628.

The emitter of the transistor 623 is connected to one of the connecting legs 405 of the plug 401, while the collector of the same is connected to the other connecting leg 405 through a relay coil 629.

The power supply plug 401 has a coil 421 one end of which is connected to one of the connecting legs 405, while the other end of the same is connected to the other connecting leg through a relay switch 630.

When the switch S on the electrical appliance A is closed while the power supply plug 401 of this embodiment is set on a power supply receptacle (not shown) with the actuating member 409 locked in the retracted state, a D.C. electric power is supplied to the high-frequency transmitter B through the diode 618 so that the transmitter transmits a sine-wave current of a high frequency which is delivered to the power supply cord 611 through the capacitor 619. This high-frequency current is superposed to the commercial power having a frequency of 50 Hz or 60 Hz. The high-frequency current, however, does not flow into the electrical appliance A because it is interrupted by the high-frequency interrupting coil 620. Thus, the high-frequency current is allowed to flow only into the plug 401.

The high-frequency transmitted by the high-frequency transmitter is preferably selected to be 2 to 3 orders of magnitude of the commercial frequency which is 50 Hz or 60 Hz. This order of high-frequency enables the high-frequency transmitter B and the high-frequency receiver C to be miniaturized while reducing mutual effect between the transmitter and receiver and minimizing the loss of power when transmitted through ordinary power supply cord. This frequency is determined by the resonance circuit constituted by the coil 614 and the capacitor 615, taking into account the values of the capacitance and resistance of the capacitor 613 and the resistor 617 in the high-frequency transmitter B.

The high-frequency signal transmitted from the power supply cord 611 does not flows into the plug 401 because it is interrupted by the high-frequency interrupting coil 621. Thus, the high-frequency wave is allowed to flow only through the high-frequency receiver C. The resonance circuit constituted by the coil 626 and the capacitor 627 resonates at the oscillating frequency of the high-frequency oscillator B and the resonance output is detected by the diode 628 and is integrated through the capacitor 625 and the resistor 624 so as to turn the transistor 623 on, thereby allowing a solenoid relay coil 629 to be connected to the power supply voltage, whereby the source power is supplied to this relay coil 629. When the relay coil 629 is energized, the relay switch 630 is closed so that the coil 421 is supplied with electric power from the connecting legs 405, 405, whereby the actuating member 409 is unlocked from the retracted state. In consequence, the actuating member 409 projects from the bottom wall of the power supply plug 401 so as to press the power supply receptacle (not shown), whereby the plug 401 comes off the receptacle by the reactional force.

Although a tuning LC type resonator is used as the high-frequency transmitter in the described embodiment, it will be clear to those skilled in the art that the high-frequency transmitter B maybe constituted by other types of LC oscillator such as of Hartley type or Colpitts type.

It will also be obvious that a pulse current can be used in place of the sine-wave current.

FIG. 22 shows a still further embodiment in which the coil 421 is supplied with electric current when an overcurrent in the power supply cord 611 is detected.

A load 631 for generating overcurrent is connected through a switch S to the power supply cord 611 of the electrical appliance A, in parallel with the load of the appliance A. An overcurrent detector D is connected in the portion of the power supply cord 611 adjacent to the power supply plug 401.

A current detecting transformer 632 is connected to one of the conductor lines of the power supply cord 611. The current detecting transformer 632 has a large ratio of turns between the primary and secondary sides thereof, so that even a small change in the primary electric current causes a large current signal in the secondary side.

The secondary side of the current detecting transformer 632 is connected through a diode 633 to a capacitor 634 and a resistor.

The ends of the capacitor 634 and the resistor 635 adjacent to the diode 633 is connected to the base of the transistor 636 the emitter of which is connected through a D.C. power supply 37 to one of the connecting legs 405 of the power supply plug 401. At the same time, the collector-side end of the transistor 636 is connected to the other connecting leg 405 through the relay coil 638.

The coil 421 in the plug 401 is connected at its one end to one of the connecting legs 405 while the other end is connected through a relay switch 639 to the other connecting leg 405.

When the switch S on the electrical appliance A is closed while the plug 401 is set on a power supply receptacle (not shown) with the actuating member 409 locked in the retracted state, a parallel circuit composed of the load of the electrical appliance and the load 631 is connected to the power supply voltage, so that the overall impedance is reduced to increase the level of the electric current. In consequence, the electric current through the power supply cord 611 is increased so that a signal of a high level is induced in the secondary side of the current transformer 632.

This signal is rectified by the diode 633 and a voltage is generated across the capacitor 634 and the resistor 635. When this voltage has become higher than the normal voltage determined by the D.C. voltage 637 delivered to the emitter of the transistor 636, the transistor 636 is turned on so as to allow an electric current to flow through the collector of the same transistor 636.

When the electric current flows through the collector, the solenoid relay coil 638 operates to close the relay switch 639 so that electric power from the power supply is delivered to the coil 421 through the connecting legs 405, 405, whereby the actuating member 409 is unlocked from the retracted state. As a result, the actuating member 409 is projected from the underside of the power supply plug 401 to press the power supply receptacle (not shown) so that a reactional force is generated to disconnect the power supply plug 401 from the power supply receptacle.

Figure 23:
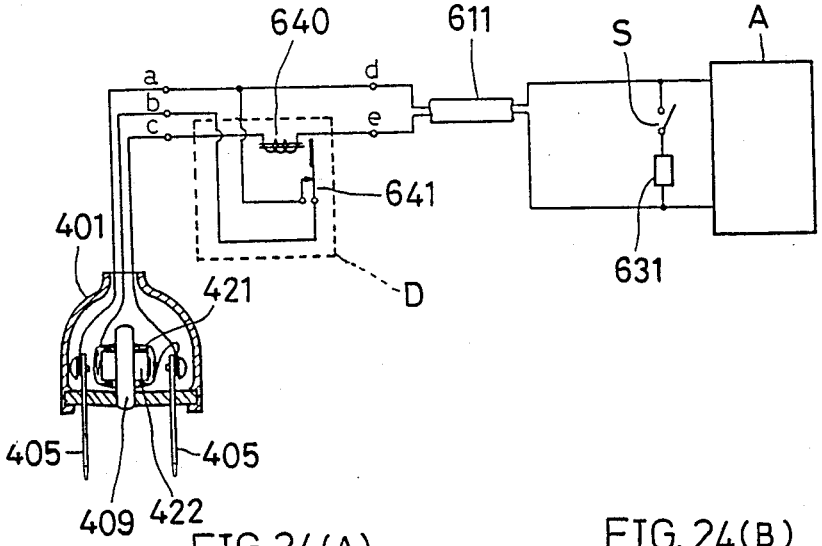
FIG. 23 is an electric wiring diagram in a still further embodiment of the present invention.

FIG. 23 shows a still further embodiment in which, as in the case of the embodiment shown in FIG. 22, the power supply plug 401 is disconnected from the power supply receptacle upon detection of an overcurrent.

In this embodiment, a solenoid relay coil 640 is connected in series in one of the conductor wires of the power supply cord 611. A relay switch 641 connected to the coil 421 is adapted to close its contact when a large electric current flows through the solenoid relay coil 640.

A description will be made hereinunder as to a still further embodiment in which a bimetal relay is used as the overcurrent detector D.

Figure 24A:
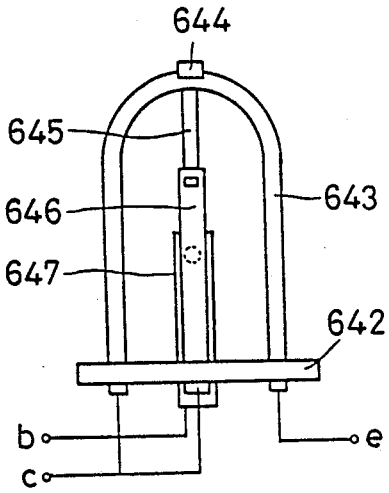
FIG. 24A is a front elevational view of a bimetal relay used in the embodiment shown in FIG. 23.
Figure 24B:
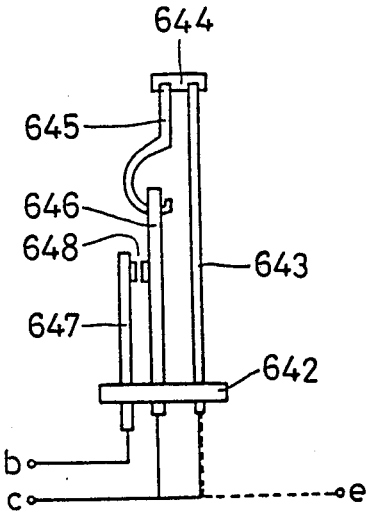
FIG. 24B is a side elevational view of the bimetal relay used in the embodiment shown in FIG. 23.

FIG. 24A is a front elevational view of a bimetal relay, while FIG. 24B is a side elevational view of the same as viewed from the left side thereof. A U-shaped bimetal relay 643 is fixed at its lower end to an insulating substrate 642 by being inserted into the same. An insulator 644 is mounted at its one end on the top of the bimetal 643. A torque spring 645 is mounted on the other end of the insulator 644. The torque spring 645 is connected to a movable plate 646 which is fixed at its one end to the insulating substrate 642. A stationary plate 647 is disposed so as to oppose the movable plate 646. An electrical contact 648 is constituted by the opposing ends of the movable plate 646 and the stationary plate 647. The torque spring 645 is used to ensure that the contact 648 is opened and closed without fail when a predetermined deflection of caused in the bimetal 643.

The bimetal relay is incorporated in the embodiment shown in FIG. 23 in the following manner. The embodiment shown in FIG. 23 has terminals a, b, c, d and e among which the terminal c is connected to one end of the bimetal 643 while the other end of the bimetal 643 is connected to the terminal e, so that the bimetal 643 is connected in series to one of the conductor lines of the power supply cord 611 so that the electric power is supplied to the electrical appliance A. The terminal c is connected to the movable plate 646, while the terminal b is connected to the stationary plate 647 through the contact 648, whereby a circuit is formed so as to allow the supply of electric current through the coil 421 in the plug 401.

When the switch S adjacent to the electrical appliance A is closed, an overcurrent flows through the power supply cord 611 so that the bimetal 643 connected in series to one of the signal lines is thermally deflected with its upper portion deflected to the left as viewed in FIG. 24B. When the deflection amount reaches a predetermined value, the end of the torque spring 645 is moved abruptly so as to urge the movable plate 646 to the left thereby closing the contact 648, whereby electric current flows through the coil 421 in the power supply plug 401.

Though a bimetal is used as the overcurrent detector in this embodiment, it will be clear to those skilled in the art that any equivalent device capable of deflecting in response to an overcurrent may be used as the overcurrent detector. For instance, a shape memory alloy can suitably be used as the overcurrent detector.

The disconnecting device capable of disconnecting the power supply plug from the power supply receptacle can be used on purpose in response to the operation of the switch s when the user wishes to finish the operation of the electrical appliance. This device also can serve as a safety device which automatically disconnect the plug from the receptacle without requiring operation of the switch S, whenever a load current greater than the rated current is detected.

The described embodiment also may have a leak current safety device composed of a current difference detector provided in the power supply plug 401 and capable of detecting difference in the electric current between two conductor lines of the power supply cord 611 and relay switches 630, 639 or 641 which operates to supply electric current to the coil 421 in the plug 401 when the difference detected by the current difference detector has been increased beyond a predetermined level.

This embodiment enables the power supply plug to be disconnected from the receptacle by a remote control without requiring any separate signal line for transmitting an unlocking signal besides the power supply cord. Since no specific signal line is required, the cost of the plug is reduced and the power supply cord is not required to a power supply cord having a small diameter can be used. This in turn reduces the space for accommodating the power supply cord in the electrical appliance, thus contributing to a reduction in the size of the electrical appliance.

Figure 26:
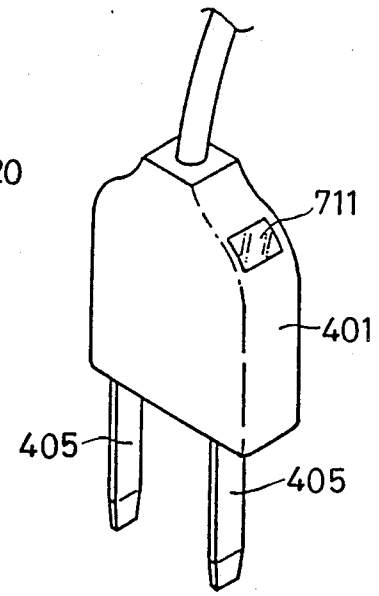
FIG. 26 is a perspective view of the embodiment shown in FIG. 26.
Figure 25:
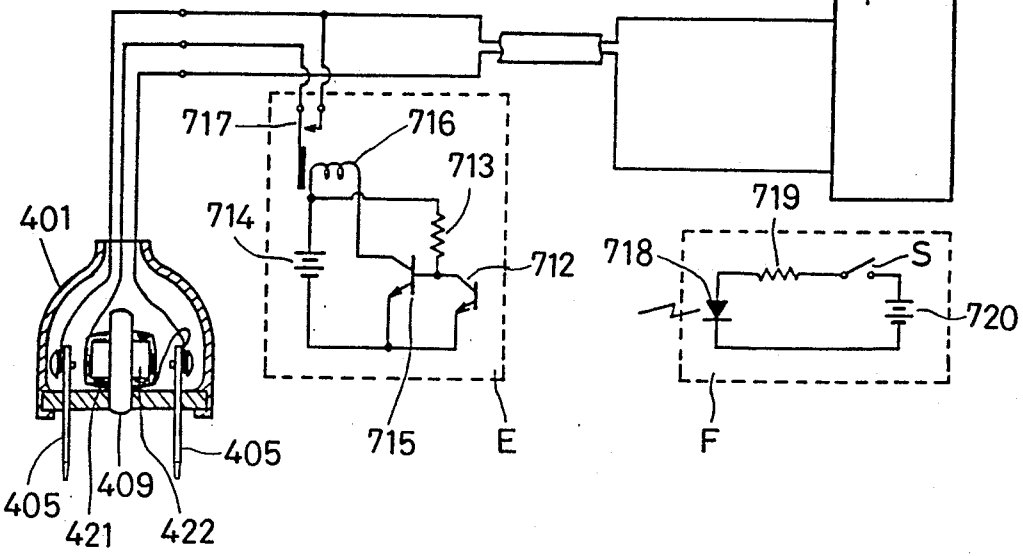
FIG. 25 is a wiring diagram in a still further embodiment of the present invention.

FIGS. 25 and 26 show a still further embodiment of the present invention in which a wireless transmission system is used for remotely controlling the supply of the electric current to the coil 421.

As shown in FIG. 26, power supply plug 401 for supplying electric power to an electrical appliance A is provided in a portion of the outer peripheral surface thereof with a window 711 for enabling a receiver C in the plug 401 to receive a wireless signal.

The electric circuit of this embodiment is shown in FIG. 25. The plug 401 is provided therein with a receiver E adapted to receive a signal from a transmitter F which is portable.

The receiver E has a receiving element constituted by a photo-transistor 712 the collector of which is connected to the plus side of the D.C. power supply 714 through a load resistor 713. The emitter of the photo-transistor 712 is connected to the minus side of the D.C. power supply 714. The photo-transistor 712 is located to confront the receiving window 711 so as to be able to receive a wireless signal such as an electromagnetic wave from the outside of the plug 401.

The receive also has a driving transistor 715 the base of which is connected to the collector of the phototransistor 712. The collector of the driving transistor 715 is connected to the plus side of the D.C. power supply through a solenoid relay coil 16. The emitter of the driving transistor 715 is connected to the minus side of the D.C. power supply 715. The arrangement is such that the contact of the relay switch 717 is closed when the solenoid relay coil 716 is supplied with electric current.

One end of the coil 421 in the power supply plug 401 is connected to one of the connecting legs 405, while the other end of the same is connected to the other connecting leg 405 through the relay switch 717.

The portable and mobile transmitter F includes a light-emitting element such as a light-emitting diode 718 or a semiconductor laser to which are connected in series a stabilizing resistor 719, an operation switch S and a D.C. power supply 720. The light emitted from the light-emitting element need not be visible by human eyes, so that the light-emitting element is preferably constituted by an infrared light-emitting diode because infrared rays can be emitted at a high efficiency.

When the signal generating switch S in the transmitter D is closed while the actuating member 409 is locked in the retracted position, electric power is supplied from the D.C. power supply 720 to the light-emitting diode through the resistor 719 so that the light-emitting diode 718 emits infrared rays. The infrared rays transmitted to the power supply plug 401 is received by the photo-transistor 712 as the receiving element, through the receiving window 711, so that the photo-transistor 712 is turned on so as to allow electric power to be supplied to the base of the driving transistor 715. In consequence, the driving transistor 715 is turned on so that the electric current is supplied to the solenoid relay coil 716.

When the solenoid relay coil 716 is energized, the relay switch 717 is closed so that electric power is supplied through the connecting legs 405, 405 to the coil 421 so that the actuating member 409 which has been locked in the retracted state is unlocked to project from the underside of the plug 401 so as to press the surface of the power supply receptacle (not shown),so that the plug 401 is separated from the receptacle by the reactional force.

Although in the described embodiment the signal for unlocking the actuating member is a simple light signal, it is possible to employ a complicated electronic circuit so as to produce a signal coded in terms of the number of pulses, pulse frequency and the pulse interval, so that the receiver operates only in response to the specific coded signal, whereby the S/N ratio of the signal is increased to ensure a high reliability of operation.

It is also possible to use, as the signal for unlocking the actuating member, a supersonic wave signal in place of the light or electromagnetic wave signal used in the described embodiment. In such a case, ceramic vibrators or the like are used as the transmitter and the receiver.

Figure 27:
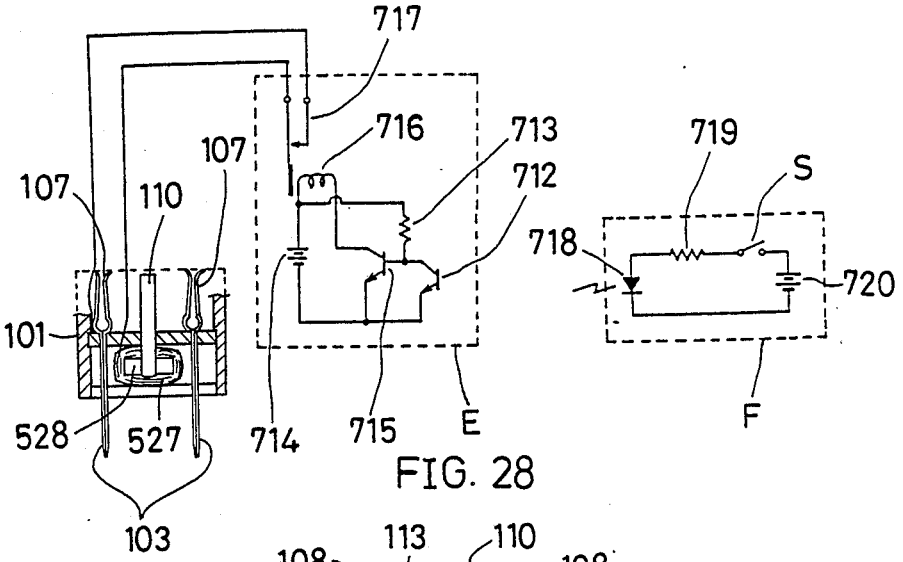
FIG. 27 is a wiring diagram of an electric power supply plug as a still further embodiment of the present invention.
Figure 28:
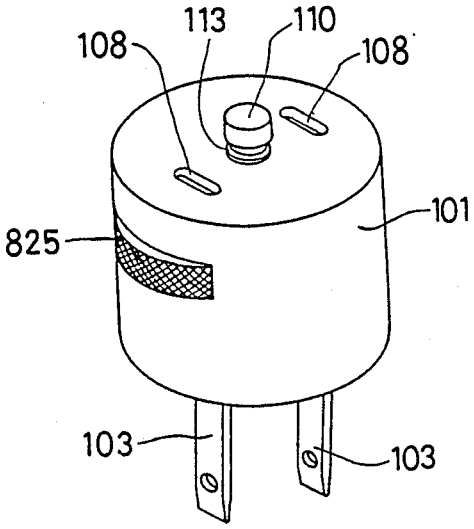
FIG. 28 is a perspective view of the embodiment shown in FIG. 27.

FIGS. 27 and 28 show a still further embodiment. This embodiment is similar to that shown in FIG. 19 except that the supply of the electric current to the coil 521 in the plug adapter is controlled by wireless means. Namely, the power supply plug adapter of this embodiment has a receiver E which is constituted by a light-receiving element positioned to confront a receiving window 825 formed in a portion of the peripheral surface of the power supply receptacle 1.

FIG. 27 shows the electric circuit incorporated in this embodiment. The electric circuit includes a portable and mobile transmitter F, as well as the above-mentioned receiver E mounted in the plug receptacle 1. The mechanical construction of the power supply adapter of this embodiment is basically the same as those of the e,embodiments shown in FIGS. 1 and 19, while the constructions of the receiver E and the transmitter F are similar to those of the embodiment shown in FIG. 25. The coil 527 in the adapter 101 is directly connected to one of the electrode legs 103 while the other end of the same is connected to the other electrode leg 103 through a relay switch 717. Other portions are materially the same as those of the embodiments shown in FIGS. 1, 19 and 25 so that they are denoted by the same reference numerals as these embodiments and detailed description is omitted in regard to such portions.

Obviously, the signal receiving window 825 can be substituted by an antenna, when an electric wave is used as the signal.

Though the embodiments described hereinbefore are constructed as a plug or a plug adapter in which connecting legs are integrally formed with concaved connecting portions 107, it will be clear to those skilled in the art that the invention can be embodied as a power supply receptacle which has concaved connecting portions connected through wire conductors directly to a power supply.

In the embodiments explained in connection with FIGS. 25 to 27, the transmitter F is portable so that the plug or the plug adapter can be separated from the receptacle by remote control even from a place spaced apart from the electrical appliance connected to the plug.

Figure 29:
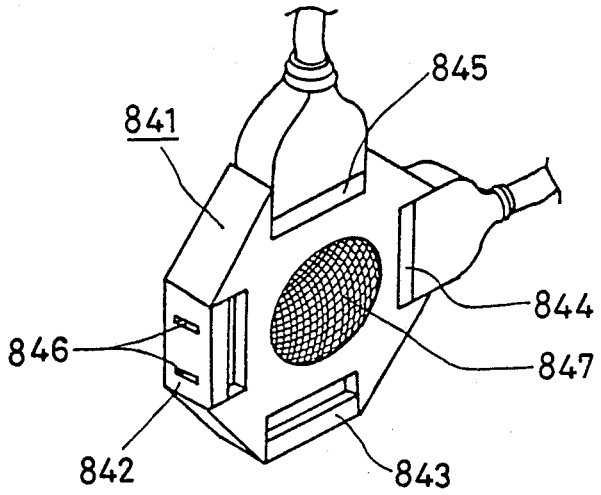
FIG. 29 is a perspective view of an electric power supply plug adapter as a still further embodiment of the invention.
Figure 30:
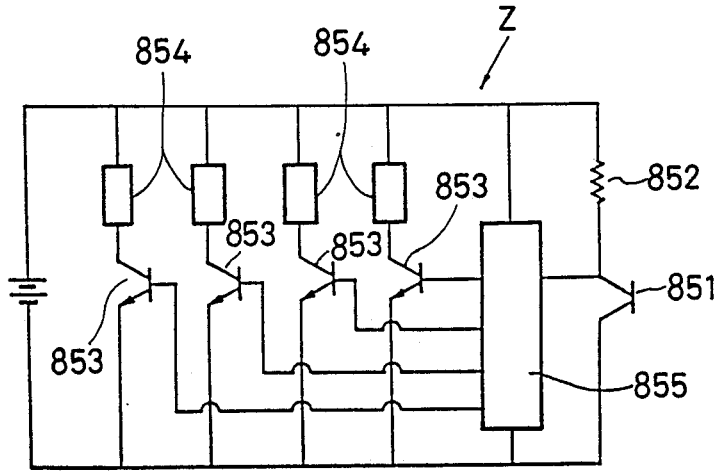
FIG. 30 is a wiring diagram of the electric wiring in the embodiment shown in FIG. 29.

FIGS. 29 and 30 are a perspective view and a circuit diagram of a plug adapter capable of connecting a plurality of plugs, as a still further embodiment of the present invention.

The plug adapter 41 has an octagonal form and is provided on the reverse side (not shown) thereof with connecting legs through which the receptacle is connected to a power supply receptacle. There are four actuating members 842, 843, 844 and 845 which are projectable radially outwardly from every other sides of the octagonal adapter 841. Each of the actuating members 842, 843, 844 and 845 is provided with a pair of rectangular through holes 846 adapted for receiving connecting legs of a power supply plug. Concaved connecting portions (not shown) are disposed inside the plug adapter 841 in alignment with the respective through holes 846. These concaved connecting portions are connected to the connecting legs (not shown) on the reverse side of the plug adapter 841 which is invisible in FIG. 29.

The plug adapter 841 is provided therein with locking mechanisms for locking each actuating member 842, 843, 844, 845 in the retracted position. The construction of the locking mechanism is materially the same as that shown in FIG. 19. In FIG. 29, the actuating members 842 and 844 are in the projected state, while the actuating members 844 and 845 are in the retracted state.

The plug adapter 841 is provided with a receiver Z which operates, upon receipt of signals from a transmitter, so as to selectively unlock the actuating members 842, 843, 844 and 845, through a circuit which is shown in FIG. 30. A hemispherical signal receiving window 847 is provided on the center of the front side of the plug adapter 841 so as to receive a signal such as a light beam from the transmitter. The circuit shown in FIG. 30 is basically the same as that shown in FIG. 27. In this case, however, solenoid relays 854, 854, 854 and 854, as well as a plurality of driving transistors 853, 853, 853 and 853, are used for enabling the four actuating members 842, 843, 844 and 845 to be selectively controlled. Thus, four solenoid relays 854 and four driving transistors 853 are combined with a single light-receiving element 851 and a single load resistance 852. In addition, a signal discrimination circuit 855 is provided for supplying electric current to the base of the selected driving transistor.

In operation, a signal of a frequency which identifies the plug to be separated from the plug adapter 841 is transmitted from a transmitter and is received by the phototransistor 851 of the receiver Z. As a result, the discrimination circuit 855 discriminates the signal frequency and delivers the signal to the base of the driving transistor 853 connected to the solenoid relay 854 associated with the power supply plug to be disconnected.

In consequence, the driving transistor 853 thus selected is turned on so that electric current flows through the associated electromagnetic relay 854, whereby the unlocking coil associated with the plug to be disconnected is energized to unlock the actuating member, e.g., 42, associated with the plug to be separated.

Although the plug adapter 841 has been described as having connecting legs on the rear side thereof for direct connection to a fixed power supply receptacle, this is not exclusive and the plug adapter may be connected to the fixed power supply receptacle through a power supply cord. It is also possible to arrange such that all the driving transistors are simultaneously turned on so as to project all the actuating members in response to a specific signal which is produced by depression of a master button provided on the transmitter.

The power supply plugs embodying the present invention have been described as having two connecting legs. Obviously, however, these power supply plugs embodying the present invention can be modified to have three legs, two for the power supply and one for grounding, as is the case of the plugs used in the U.S.A.

As has been described, according to the present invention, the separation of a power supply plug from a power supply receptacle can be effected by a single hand by, for example, pressing a push button. Thus, the power supply plug in accordance with the present invention can suitably be used as the power supply of electrical appliances which require repetitional insertion and withdrawal of the plug, e.g., an iron, drier, toaster and a cleaner. The plug of the invention, which can easily be separated from the receptacle by a single-hand operation, is specifically advantageous when it is used in combination with a receptacle connected to an extension cord, since in such a case the users have been obliged to use both hands.

Furthermore, the user is protected from electric shock during insertion and withdrawal of the plug because the most part of the connecting legs is hidden by the cover so that there is no risk for the use to touch the charged conductive part.

It is also to be noted that, since the actuating member is not unlocked unless the connecting legs of the plug are fully inserted into the receptacle, the plug will automatically come off when the electrical contact between the plug and the receptacle is incomplete. This ensures that the plug is used always in complete electrical contact with the receptacle.

What is claimed is:

1. An electric power supply connector for supplying a power source voltage to an electrical appliance, comprising:

connecting means made of a metallic material having high electrical conductivity and formed to be projected from or recessed into the surface of a main part of said connector;

actuating means resiliently urged to project from the inside to the outside of said connector so as to be able to project from a surface of said main part of said connector;

locking means including a locking groove formed in a wall of said actuating means and a portion of an interlocking member which is movable in the direction perpendicular to said actuating member and urged by a spring, said portion of said interlocking member being engageable with said locking groove by the force of said spring when said, said locking means being adapted to lock, through the engagement between said portion of said interlocking member and said locking groove, said actuating member in a retracted state where the end of said actuating member is held near the surface of said main body of said connector; and unlocking means for unlocking said actuating member from said retracted state by urging said interlocking member against the force of said spring.

2. An electric power supply connector according to claim 1, wherein said unlocking means includes a push button provided on one end of said interlocking member and projected laterally from a side of said connector so as to be manually pressed against the force of said spring thereby unlocking said actuating member from said retracted state.

3. An electric power supply connector according to claim 1, wherein said unlocking means includes an expandable and contractable bellow receiving an end of a power supply cord, a spring disposed in said bellows and adapted for contracting said bellows, a string having one end retained at a position near the hole receiving said power supply cord and the other end connected to said interlocking member, whereby, as said power supply cord is pulled, said bellows is expanded to pull said string thereby causing said interlocking member to move against the force of said spring.

4. An electric power supply connector according to claim 1, wherein said unlocking means includes a solenoid with a coil wound thereon, said solenoid being adapted to produce, when said coil is energized, a force which acts against the force of said spring.

5. An electric power supply connector according to claim 1, wherein said actuating member includes a cover having holes receiving connecting legs of said connecting means and slidably fitting on the main part of said connector.

6. An electric power supply connector according to claim 1, wherein said actuating member is urged by a spiral spring the diameter of which is progressively increased in the direction away from the surface of said connector.

7. An electric power supply connector according to claim 2, wherein said actuating member includes a cover having holes receiving connecting legs of said connecting means and slidably fitting on the main part of said connector.

8. An electric power supply connector according to claim 2, wherein said actuating member is urged by a spiral spring the diameter of which is progressively increased in the direction away from the surface of said connector.

9. An electric power supply connector according to claim 3, wherein said actuating member includes a cover having holes receiving connecting legs of said connecting means and slidably fitting on the main part of said connector.

10. An electric power supply connector according to claim 3, wherein said actuating member is urged by a spiral spring the diameter of which is progressively increased in the direction away from the surface of said connector.

11. An electric power supply connector according to claim 4, wherein said actuating member includes a cover having holes receiving connecting legs of said connecting means and slidably fitting on the main part of said connector.

12. An electric power supply connector according to claim 4, wherein said actuating member is urged by a spiral spring the diameter of which is progressively increased in the direction away from the surface of said connector.

13. An electric power supply connector according to claim 4, wherein said unlocking means further includes a switch provided adjacent to said electrical appliance, a high frequency transmitter capable of transmitting a high frequency signal in response to closing of said switch, and a high-frequency receiver provided in said connector and adapted to allow an electric current to flow through said coil upon receipt of said high-frequency signal from said high-frequency transmitter, said high-frequency transmitter and said high-frequency receiver being connected to each other through a power supply cord through which electric power is supplied to said electrical appliance.

14. An electric power supply connector according to claim 4, wherein said unlocking means includes a switch provided on said electrical appliance and connected through an overcurrent generating load in parallel to the load of said electrical appliance, and an overcurrent detector provided in the power supply cord through which said connector is connected to said electrical appliance and adapted to allowing said coil to be energized when an overcurrent is generated in response to operation of said switch to flow in said power supply cord.

15. An electric power supply connector according to claim 4, wherein said unlocking means includes a receiver disposed in said connector and exposed through a signal receiving window, said receiver being adapted to allow said coil to be energized upon receipt of a signal such as light, electromagnetic wave or a supersonic wave transmitted from a mobile transmitter.

16. An electric power supply connector according to claim 14, wherein said overcurrent detector includes a current detection transformer connected in series to one of the conductor wire of said power supply cord, and said unlocking means further includes a relay switch adapted to operate in response to a signal generated in the secondary side of said current detection transformer and adapted to allow said coil to be energized in response to said signal.

17. An electric power supply connector according to claim 14, wherein said overcurrent detector includes a solenoid relay coil connected in series to one of the conductor wires of said power supply cord, and said unlocking means further includes a relay switch adapted to be operated by said solenoid relay coil so as to allow said coil to be energized in response to said signal.

18. An electric power supply connector according to claim 14, wherein said overcurrent detector includes a member connected in series to one of the conductor wires of said power supply cord and deflectable in response to electric current so as to close an electrical contact thereby allowing said coil to be energized.

* * * * *